United States Patent [19]

Rosato

[11] Patent Number: 5,000,414

[45] Date of Patent: Mar. 19, 1991

[54] CHRISTMAS TREE STAND

[75] Inventor: Leo Rosato, Ontario, Canada

[73] Assignee: Ros-Ika Enterprises Inc., Kemptville, Canada

[21] Appl. No.: 473,805

[22] Filed: Feb. 2, 1990

[30] Foreign Application Priority Data

Feb. 3, 1989 [CA] Canada ..... 590388

[51] Int. Cl.[5] ..... A47G 7/02

[52] U.S. Cl. ..... 248/524; 47/40.5

[58] Field of Search ..... 248/519, 523, 524, 527, 248/146, 410, 910; 47/40.5; 24/710.4, 649

[56] References Cited

U.S. PATENT DOCUMENTS

| | | | |
|---|---|---|---|
| 1,846,891 | 2/1932 | Miller . | |
| 1,855,762 | 4/1932 | Kaminski | 248/527 |
| 2,044,192 | 6/1936 | Templin, Jr. . | |
| 2,051,969 | 8/1936 | Shastock | 248/410 |
| 2,613,899 | 10/1952 | Wagner | 248/527 |
| 2,650,647 | 9/1953 | MacKnight | 248/410 |
| 2,652,217 | 9/1953 | Schulz . | |
| 2,701,699 | 2/1955 | Chapin . | |
| 2,733,032 | 1/1956 | Farley et al. . | |
| 2,815,908 | 12/1957 | Scanland . | |
| 2,849,204 | 8/1958 | Petrick | 248/410 |
| 2,978,780 | 4/1961 | Clarkson . | |
| 2,980,377 | 4/1961 | Nielsen et al. . | |
| 2,994,498 | 8/1961 | Sager . | |
| 3,729,906 | 5/1973 | Coblentz . | |
| 4,005,942 | 2/1977 | Gilb | 248/903 |
| 4,034,505 | 7/1977 | Lydall . | |
| 4,130,965 | 12/1978 | Patton et al. . | |
| 4,156,323 | 5/1979 | Scheffler . | |
| 4,286,409 | 9/1981 | Taylor et al. . | |
| 4,496,129 | 1/1985 | Waterman et al. . | |
| 4,571,881 | 2/1986 | Lathim . | |

FOREIGN PATENT DOCUMENTS

| | | | |
|---|---|---|---|
| 3609357 | 10/1987 | Fed. Rep. of Germany | 248/523 |

*Primary Examiner*—Ramon O. Ramirez
*Assistant Examiner*—Robert A. Olson
*Attorney, Agent, or Firm*—Rogers & Scott

[57] ABSTRACT

A tree stand comprising an open receptacle shaped to define inner and outer walls on which fastening means are provided to fasten a tree to the receptacle, the fastening means comprising a plurality of pins extending radially about the axis of the tree and slidable within a number of corresponding apertures in the walls of the receptacle. Locking assemblies to interfere with such sliding movement are characterized by a lever having an aperture between its ends for location on the pin between the inner and outer walls of the receptacle, the diameter of the aperture being sufficiently greater than the diameter of the pin to allow the pin to move freely when the lever is in a release position perpendicular to the axis of the pin, while being sufficiently small to interfere with such movement of the pin when the lever is in a lock position, inclined relative to the axis of the pin and in abutment with the pin. Biasing means biase the lever into the lock position toward said obstacle means provided on the outer wall.

14 Claims, 5 Drawing Sheets

CHRISTMAS TREE STAND

BACKGROUND OF THE INVENTION

This invention relates to a Christmas tree stand for holding cut natural trees, usually conifers, in an upright configuration for display at Christmas or other festive occasions.

Numerous such tree stands have been developed and a great majority of these stands may be characterized by the shape of the receptacle in which the tree trunk is received in use. In every case, the receptacle is designed to have an effective diameter which is greater than the tree trunk to provide a wide base for supporting the tree. The receptacle may comprise a central well that holds the tree and water for sustaining the tree, the well being supported by radially outwardly extending legs or a skirt which surrounds the well and supports it like a buttress. In some cases, the well itself is made wide enough at the base to be self-supporting.

The fastening means used to fasten the tree to the receptacle usually comprise a number of thumb screws spaced equally around the circumference of the receptacle and extending radially relative to the axis of the tree. The receptacles have threaded apertures for receiving the thumb screws and the screws are brought into engagement with the tree by turning the screws. This is a bothersome task commonly executed by a person crouching or lying on the floor and requires dexterity and patience.

The process of fastening the tree to the receptacle also becomes hazardous where the receptacle is of flimsy construction and of insufficient mass to counterbalance a tree which is twisted or slightly inclined and, as a result, has a tendency to topple over.

An object of this invention is to provide a tree stand in which the fastening means overcome the abovementioned problems associated with screw fasteners so that fastening of the tree to the receptacle may be carried out quickly, simply, and effectively.

SUMMARY OF THE INVENTION

In accordance with the invention, there is provided a tree stand comprising an open receptacle shaped to define inner and outer walls on which fastening means adapted to fasten a tree to the receptacle are provided. The fastening means comprise a plurality of pins extending radially about the axis of the tree and are slidable within a number of corresponding apertures provided in the walls of the receptacle. Locking assemblies to interfere with such sliding movement of the pins are characterized by a lever having an aperture between its ends for location of the lever on a pin between the inner and outer walls of the receptacle, the diameter of the aperture being sufficiently greater than the diameter of the pin to allow the pin to move freely when the lever is in a release position perpendicular to the axis of the pin, while being sufficiently small to interfere with such movement of the pin when the lever is in a lock position, inclined relative to the axis of the pin and in abutment with the pin. Obstacle means provided on the outer wall of the receptacle halt movement of the lever toward the outer wall and biasing means biase the lever into the lock position. Access means for moving the lever against the biasing means into a release position are also provided.

BRIEF DESCRIPTION OF THE DRAWINGS

A preferred embodiment of the invention will now be described with reference to the accompanying drawings, in which.

DESCRIPTION OF THE PREFERRED EMBODIMENTS

Figure 1:
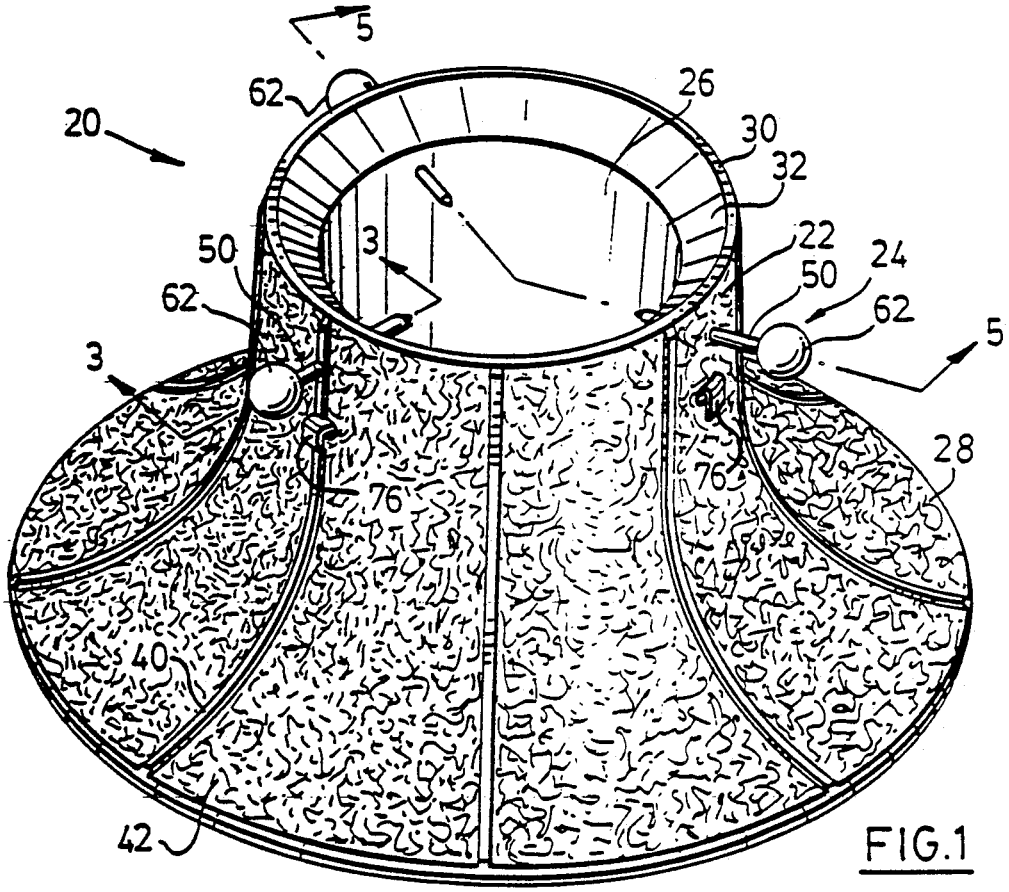
FIG. 1 is a perspective view from the top illustrating a Christmas tree stand according to the invention.
Figure 2:
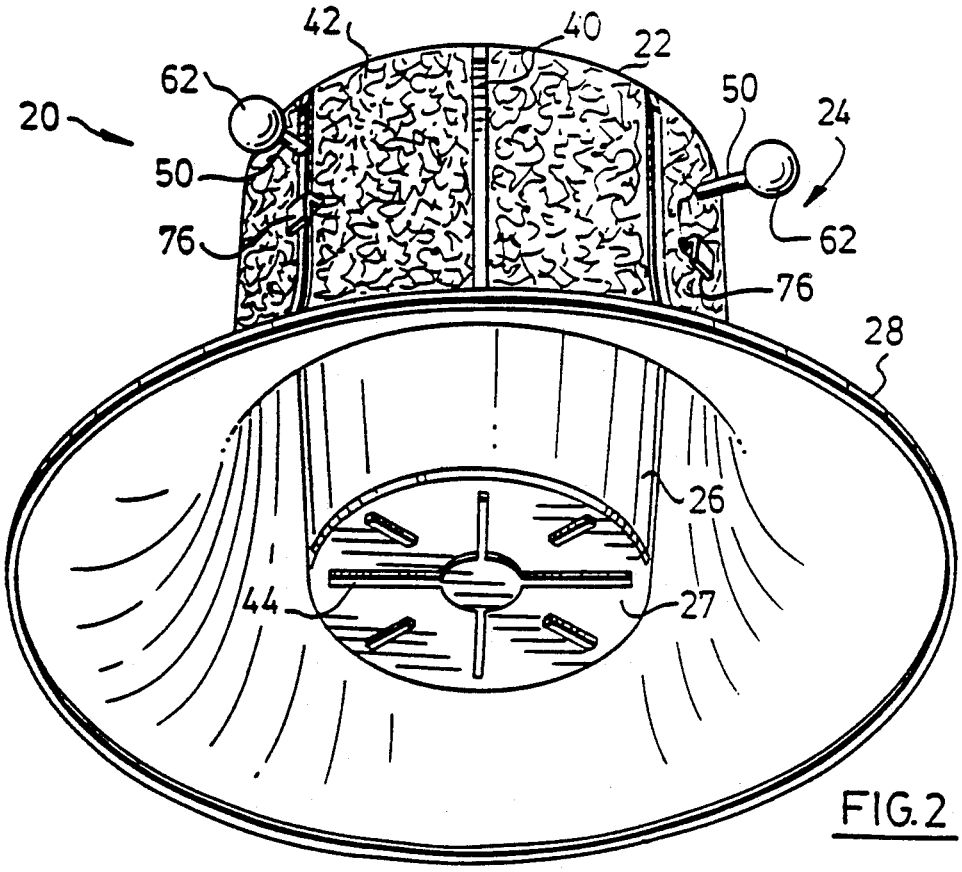
FIG. 2 perspective view from the bottom of the stand of FIG. 1.

Referring firstly to FIGS. 1 and 2, there is illustrated a Christmas tree stand according to the invention and generally indicated by the numeral 20. The stand 20 comprises a receptacle 22 which is open at the top (as drawn) and fastening means generally indicated by the numeral 24 secured to the receptacle 22 near the upper end of the stand 20.

The receptacle will now be described in some detail and a description of the fastening means will follow.

Figure 6:
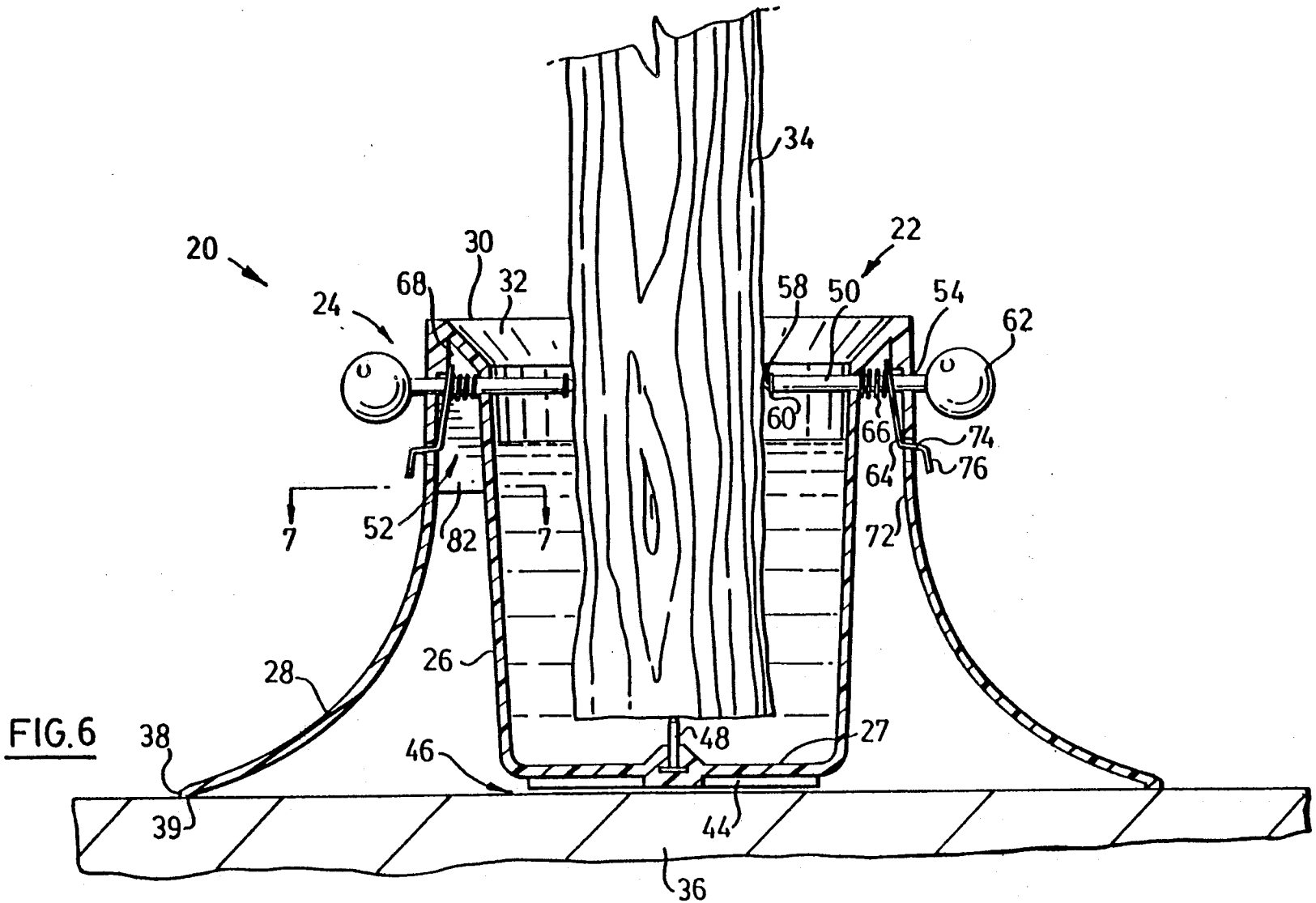
FIG. 6 is a compound section through line 5—5 of FIG. 1 illustrating the stand in use with a tree placed in a central well forming part of the stand together with water for sustaining the tree.

The receptacle 22 includes an inner substantially tubular well 26 which has a closed bottom 27 so as to hold water for sustaining a tree 34 (FIG. 6) placed in the well. An outer peripheral skirt 28, radially spaced from the well 26 and concentric with the well, is adapted to buttress the well and support the load of the stand 20 containing the tree and water for sustaining the tree. As indicated in FIG. 6, the well 26 and skirt 28 are integrally moulded from synthetic plastic material, preferably 20% talc filled polypropelene, and their respective upper edges meet at the top of the receptacle 22 to define a bevelled edge 30 for a pour lip 32 which slopes inwardly and is formed on the inner surface of the well 26. The skirt 28 is flared at the bottom so that it inscribes a large circular area and defines a base of which the effective diameter is substantially greater than the diameter of the trunk of the tree. To maximize the area of the skirt 28 which meets a supporting surface or floor 36, and which bears the load of the stand, a peripheral flange 38 with a flat mating surface 39 is provided integrally with the stand at the outer end of the skirt 28.

To enhance the appearance of the stand, the skirt 28 has a series of equally spaced, radially extending ribs 40 which extend throughout the height of the skirt and project a small distance above the outer surface of the skirt. In addition, a decorative relief pattern 42 is moulded on the surface of the skirt between the ribs 40.

Figure 7:
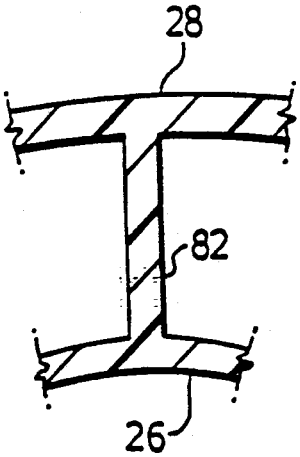
FIG. 7 (drawn adjacent FIG. 5) is a cross-sectional view through line 7—7 of FIG. 6 illustrating webs connecting inner and outer walls of the stand.

The walls of the well 26 are inwardly inclined toward the bottom 27 so that the top of the well is larger than the bottom and a plurality of the receptacles may be nested during storage or shipping. At the upper end of the receptacle, a plurality of radially extending webs 82 (FIGS. 6, 7) join the skirt 28 to the well 26 over about one third of the height of the receptacle to improve the strength and rigidity of the stand.

The outer surface of the well 26 on the bottom 27 has a plurality of radially extending ribs 44 which project from the bottom 27 and are spaced from each other to accommodate the fibers of a rug floor covering between the ribs. It will be seen in FIG. 6 that the bottom surface of the ribs on the bottom 27 of the well 26 are upwardly spaced from the flange 38 on the skirt 28 thereby leaving a small gap generally indicated by arrow 46 between the well and the floor 36. In this way, the skirt 28 will bear substantially the entire weight of the loaded stand so that the likelihood of the tree 34 toppling over is minimized.

The tree 34 is further secured by a stainless steel spike 48 which is moulded into the well so as to extend upwardly for engagement with the exposed grain of the tree 34.

The stand 20 has three pins 50, forming part of the fastening means 24, and extending radially about the axis of the tree. The pins are slidable within three pairs of aligned apertures 54, 56 provided in the skirt and the well respectively, at intervals equally spaced about the circumference of the receptacle so as to subtend an angle of 120° therebetween.

The fastening means will now be described in more detail with particular reference to FIGS. 3 to 5 which illustrate one of the pins 50 and an associated locking assembly 52.

The pin 50 has a pointed inner end 58 which is adapted to pierce the trunk of the tree 34 and a groove is provided on the pin adjacent the pointed end to accommodate a retaining ring or circlip 60. A knob 62 made of synthetic plastic similar to the receptacle 22 is pressed onto the outer swaged end of the pin 50 to define a handle for sliding the pin through the apertures in the stand.

A lever 64, made of zinc coated steel plate has an aperture 70 between its ends, and is located on the pin 50 between the well 26 and an inwardly projecting shoulder 68 formed on the inner surface of the skirt 28. The pin 50 also holds a compression spring 66 placed between the skirt 28 and the well 26 and located to bear on the lever 64 at one end so as to push the lever against the shoulder 68 and on the well 26 at the other end. The spring 66 thus biases the lever 64 into a lock position where it is inclined to and touching the pin 50 (FIG. 3, 5).

The diameter of the aperture 70 (FIG. 5) in the lever 64 is sufficiently small that when the lever pivots on the shoulder 68 under urging from the spring 66 to bring the lever to the lock position, the lever engages the pin 50 and interferes with sliding of the pin through the lever.

The diameter of the aperture in the lever 64 is also large enough to allow the pin to slide freely through the lever between a retracted configuration spaced from the tree 34 (FIG. 4) and an extended configuration in which the pin 50 engages the tree 34 (FIG. 3) when the lever is brought to a release position (FIG. 4) in which the lever is perpendicular to the axis of the pin 50.

Figure 5:
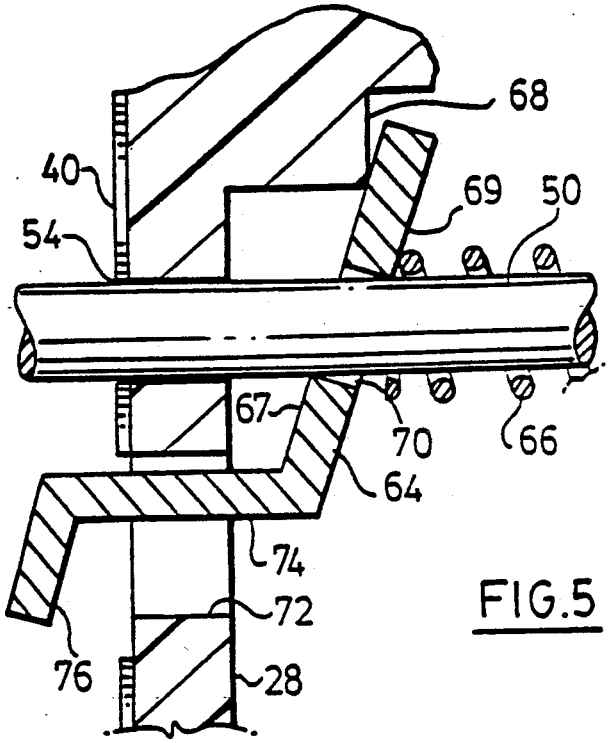
FIG. 5 is an enlarged view of the circled area 5 of FIG. 3 showing the lever in section.

It will be understood that leading and lagging surfaces of the lever 64, respectively indicated by numerals 67 and 69 in FIG. 5, both engage the pin 50 in the lock position, and that a pulling force on the knob 62, for example to withdraw the pin 50 from the trunk of the tree, is resolved into an upward component which urges the leading surface 67 of the lever towards the pin 50. Continued movement of the lever 64 with the pin 50 is blocked by the shoulder 68.

Conversely, a pushing force on the knob 62 to bring the pin 50 toward the trunk of the tree, is resolved into a downward component which urges the lagging surface 69 towards the pin and the well 26 but because there is no obstacle like the shoulder 68 in the path of the lever, the lever is pulled with the pin. Upon continued inward movement of the pin, the lever 64 may become momentarily disengaged from the pin until it relocates on a new position along the pin axis under urging from the spring 66. Continued movement of the lever 64 with the pin 50 toward the tree 34 is thus hindered but not blocked when the lever is in the lock position.

The locking assembly 52 thus operates to prevent withdrawal of the pin 50 when the lever is biased into the lock position while still allowing the pin to be pushed inwardly toward engagement with the trunk of the tree.

Access means to move the lever 64 against the spring 66 and bring it into the release position are provided in the form of an access aperture 72 provided in the skirt 28 and an extension 74 defined by a first outward bend in the lever 64 and shaped to extend between the inner and outer surfaces of the skirt 28 through the access aperture 72. A second bend in the lever defines a stop 76 transverse to the extension 74 which is adapted to engage the outer surface of the skirt 28 (FIG. 3) and to halt continued movement of the lever 64 when the release position is reached.

Figure 3:
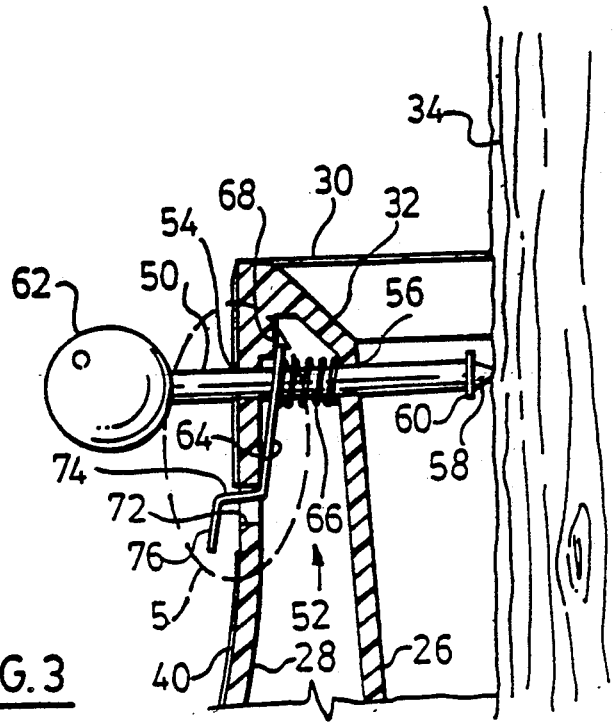
FIG. 3 a partly sectioned view of the stand taken through line 3—3 of FIG. 1 and showing a pin in an extended configuration engaging a tree placed in the stand and a lever which forms part of a locking assembly for the pin, in a lock position.
Figure 4:
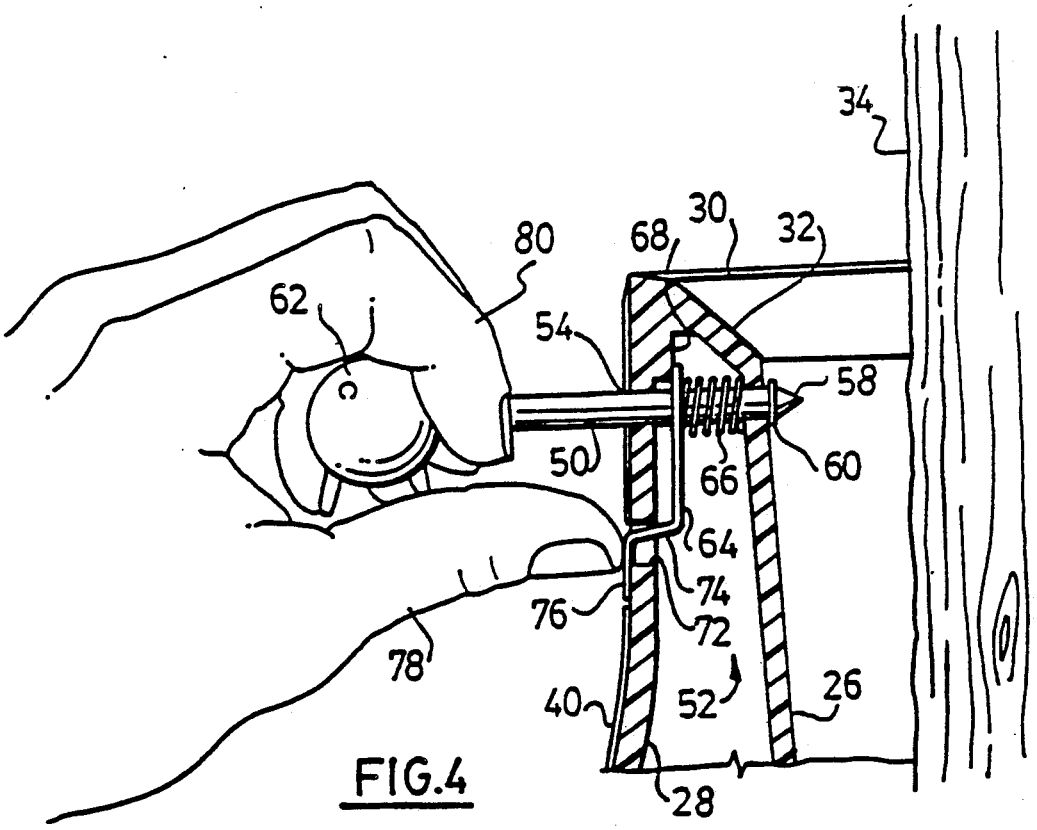
FIG. 4 is a similar view to FIG. 3 illustrating the pin in a retracted configuration spaced from the tree and the lever in a release position.

In FIGS. 3 to 5, it will be noted that the pin 50 penetrates the receptacle 22 through one of the decorative ribs 40, and accordingly, the rib is moulded with an interruption in the vicinity of the access aperture 72 so as to accommodate the stop 76.

While clearly the dimensions of the stand may vary, the well will typically have a height of 8 inches and a bottom diameter exceeding 5 inches. The outside diameter of the flange will be about 17 inches. In use, the well will have a fluid capacity of approximately 2 liters according to the size the trunk of the tree, and the estimated dry weight of the stand will be approximately 5 lbs so that together with the additional ballast provided by water, a 5 or 6 foot tree having normal variations and irregularities in the trunk and the distribution of its branches should be adequately supported and be in no danger of toppling over.

To assemble each of the locking assemblies to the receptacle 22, the inner end of the lever 64 is inserted through the access aperture 72 and positioned between the skirt 28 and the well 26 with the lever aperture 70 in alignment with the skirt aperture 54. The spring 66 is then inserted from the bottom of the receptacle between the skirt 28 and the well 26 and positioned in alignment with the apertures 70, 54, 56 on the lever, skirt and well respectively. Finally, the pin 50 is threaded through the apertures with the pointed end 58 lying inside well 26. To complete the assembly, and prevent the fastening means from becoming disassembled, the circlips 60 are introduced at the open end of the receptacle into the well and placed in the grooves behind the pointed end 58 of each pin.

In use, a tree is placed in an upright configuration inside the well with the spike 48 penetrating the exposed grain at the bottom of the tree. The outer end of each of the pins 50 is grasped by the knobs 62 and the pins are slid through the receptacle 22 so as to bring the pointed ends 58 into engagement with the trunk of the tree 34.

Even though the load on the stand will cause the well 26 to sag so as to reduce the height of the gap 46, any fibers in a rug floor covering will be accomodated between the ribs 44 on the bottom of the well. Thus, even where the fibers are long enough to bridge the gap 46, the bulk of the load will be carried by the skirt and the likelihood of the stand toppling over or swaying will be minimized.

Conveniently, water to sustain the tree may be poured against the bevelled edge 30 and over the pour lip 32 into the well 26 and the level of water may be topped up in like manner, as required.

To disassemble the tree, the levers 64 are successively brought to the release position by pushing with a thumb 78 on the respective lever extensions and stops 74, 76 and the pins 50 are disengaged from the tree 34 by pulling on the knobs 62 with the fingers 80 of the same hand (FIG. 4). Once the pins have cleared the tree, the pins 50 and the levers 64 are simply released to allow the coil springs 66 to return the levers to the lock position. The tree 34 may then be removed from the spike 48 and disposed of in usual fashion while any remaining water is poured out by tipping the receptacle.

It will be understood that several variations may be made to the above described embodiment of the invention without departing from the scope of the claims. In particular, it will be understood that the shape of the receptacle may vary considerably and may include various alterations, such as strengthening ribs on the outer surface of the well in addition to or instead of the webs 82.

Figure 8:
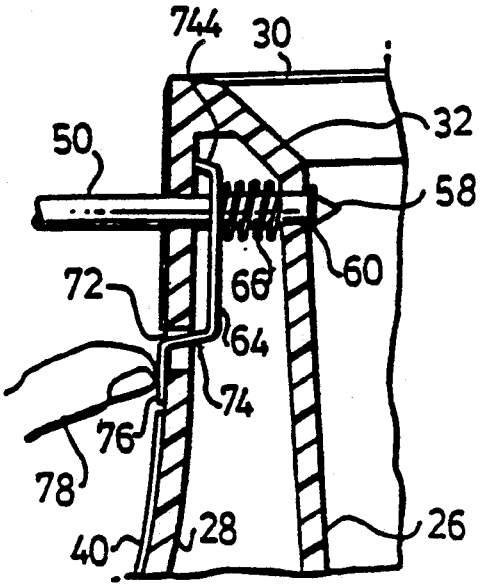
FIGS. 8 to 10 are views similar to FIG. 4 showing alternative embodiments of the invention.

The shoulder 68 may be replaced by a boss moulded with the receptacle or some other projection like the end of a screw which may be countersunk at its outer end into the skirt 28. Alternatively, the lever itself may be provided with an additional extension 744 (FIG. 8) remote from the extension 74 and adapted to reach the inner surface of the skirt 28 and to maintain contact with the skirt both in a release position in which the main body of the lever is perpendicular to the pin and a lock position where the lever is inclined relative to the pin, the other end of the lever being movable as described above with reference to FIGS. 3 to 5.

Figure 9:
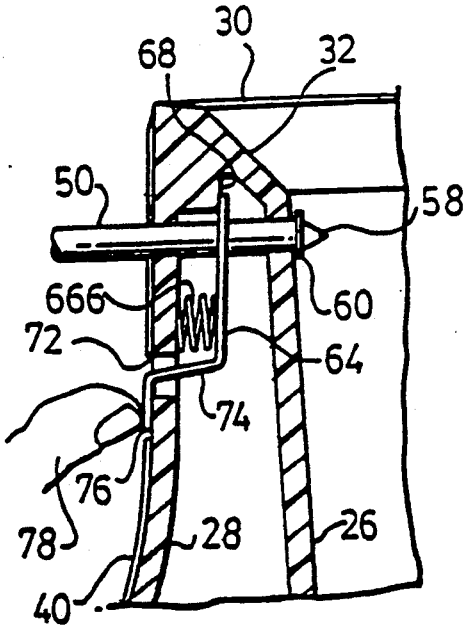

The biasing means for bringing the lever into the lock position may also take the form of a tension spring 666 (FIG. 9) located between the lever 64 and skirt 28 and adapted to pull the lever 64 into the inclined lock position. The exemplary embodiment of FIG. 8 also shows the spring 666 fixed at either end to the skirt 28 and the lever 64 respectively, and spaced from the pin 50, instead being located on the pin.

Figure 10:
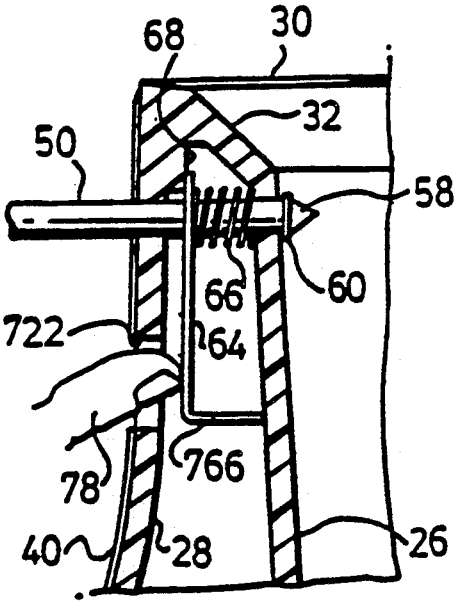

The access means may also vary and will include, for example, an access aperture large enough to allow a finger to penetrate the skirt into the area between the skirt and the well and to push on the lever without the intermediary of an extension to the lever. An example of such an embodiment is shown in FIG. 10, where the aperture is indicated by numeral 722 and the lever 64 has a stop 766 in the form of an inwardly directed bend in the lever adapted to engage the outer surface of the well 26 and halt continued movement of the lever 64 when the release position of the lever is reached.

Finally, it will be understood that the pins for engaging the tree trunk may take various configurations including pins of hexagonal section and that the materials of construction may also vary considerably.

I claim:

1. A Christmas tree stand for holding a cut natural tree in an upright configuration comprising an open receptacle adapted, in use, to receive the trunk of the tree and having a base of which the effective diameter is substantially greater than the diameter of the trunk, and fastening means, secured to the receptacle, adapted to engage the tree so as to fasten the tree to the receptacle, the fastening means comprising:

a number of pins extending radially about the axis of the tree, in use, and slidable within a corresponding number of apertures provided in the receptacle for movement between a retracted configuration spaced from the tree and an extended configuration engaging the tree; and a number of releasable locking assemblies, corresponding to the number of pins, for restricting said movement of the pins, each locking assembly including: a lever having an aperture between its ends for location of the lever on the associated pin between inner and outer walls of the receptacle radially spaced from each other relative to the axis of the tree, the diameter of said aperture being sufficiently greater than the diameter of the pin to allow the pin to move freely between said retracted and extended configurations when the lever is in a release position perpendicular to the axis of the pin, and said diameter being sufficiently small to interfere with such movement when the lever is in a lock position inclined relative to the axis of the pin and in abutment with the pin;

obstacle means located between the lever and the outer wall of the receptacle adapted to block movement of the lever toward the outer wall;

biasing means, having two ends, for biasing the lever toward said obstacle means into said lock position and located, in use, between the lever and one of said inner and outer walls of the receptacle so as to bear on the lever at one end and on the receptacle at the other end; and access means for moving the lever against said biasing means and bringing the lever into said release position so that the associated pin may be slid out of the extended configuration for removal of the tree from the stand.

2. A stand according to claim 1 in which the fastening means has three pins equally spaced about the circumference of the receptacle and subtending an angle of 120° therebetween.

3. A stand according to claim 2 in which the pins each have a pointed inner end adapted to pierce the trunk of the tree and a knob at the outer end for sliding the pins between said retracted and extended configurations.

4. A stand according to claim 1 in which the biasing means comprises a compression spring located between the lever and said inner wall.

5. A stand according to claim 1 in which the access means comprises an aperture in the outer wall of the receptacle and an extension of the lever which protrudes through said aperture.

6. A stand according to claim 1 including stop means to stop continued movement of the lever against the biasing means from said lock position beyond the release position.

7. A stand according to claim 1 in which the receptacle comprises an inner substantially tubular well closed at one end and defining said inner wall and adapted to receive the tree and hold water, in use, and an outer peripheral skirt, radially spaced from the well and concentric with the well, the skirt being flared at the bottom and defining said outer wall.

8. A stand according to claim 7 in which the obstacle means is defined by an inwardly projecting shoulder formed on the inner surface of the skirt facing the well.

9. A stand according to claim 7 in which the well has a centrally located spike extending upwardly from a floor of the well and adapted to engage the exposed grain of the tree.

10. A stand according to claim 7 in which the operatively outer and lower surface of the well has a plurality of radially extending ribs spaced from each other to accommodate therebetween the fibres of a rug floor covering on which the stand rests in use.

11. A stand according to claim 7 in which the operatively outer and lower surface of the well is upwardly spaced from the operatively lower surface of the skirt so that, in use, the skirt will bear substantially the entire weight of the stand and the tree.

12. A stand according to claim 7 in which the inner surface of the well at the operatively upper end slopes inwardly so as to facilitate pouring of water into and out of the well.

13. In a Christmas tree stand for holding a cut natural tree in an upright configuration comprising an open receptacle adapted, in use, to receive the trunk of the tree and having a base of which the effective diameter is substantially greater than the diameter of the trunk and fastening means, secured to the receptacle, adapted to engage the tree so as to fasten the tree to the receptacle, the improvement in which the fastening means comprises:

a number of pins extending radially about the axis of the tree, in use, and slidable within a corresponding number of apertures provided in the receptacle for movement between a retracted configuration spaced from the trunk and an extended configuration engaging the trunk; and a number of releasable locking assemblies, corresponding to the number of pins, for restricting said movement of the pins, each locking assembly including: a lever having an aperture between its ends for location of the lever on the associated pin between inner and outer walls of the receptacle radially spaced from each other relative to the axis of the tree, the diameter of said aperture being sufficiently greater than the diameter of the pin to allow the pin to move freely between said retracted and extended configurations when the lever is in a release position perpendicular to the axis of the pin, and said diameter being sufficiently small to interfere with such movement when the lever is in a lock position inclined relative to the axis of the pin and in abutment with the pin;

obstacle means located between the lever and the outer wall of the receptacle adapted to block movement of the lever toward the outer wall;

biasing means, having two ends, for biasing the lever toward said obstacle means into said lock position and located, in use, between the lever and one of said inner and outer walls of the receptacle so as to bear on the lever at one end and on the receptacle at the other end; and access means for moving the lever against said biasing means and bringing the lever into said release position so that the associated pin may be slid out of the extended configuration for removal of the tree from the stand.

14. A Christmas tree stand for holding a cut natural tree in an upright configuration comprising:

an open receptacle having an inner substantially tubular well closed at one end and adapted, in use, to receive the trunk of the tree, and an outer peripheral skirt radially spaced from the well and concentric with the well, the skirt being flared at the bottom and adapted to buttress the well;

fastening means, secured to the receptacle, adapted to engage the trunk so as to fasten the tree to the receptacle, the fastening means comprising:

a number of pins extending radially about the axis of the tree, in use, and slidable within a corresponding number of apertures provided in the receptacle for movement between a retracted configuration spaced from the trunk and an extended configuration engaging the trunk; and a number of releasable locking assemblies, corresponding to the number of pins, for restricting said movement of the pins, each locking assembly including:

a lever having an aperture between its ends for location of the lever on the associated pin between the well and skirt, the diameter of said aperture being sufficiently greater than the diameter of the pin to allow the pin to move freely between said retracted and extended configurations when the lever is in a release position perpendicular to the axis of the pin, and said diameter being sufficiently small to interfere with such movement when the lever is in a position inclined relative to the axis of the pin and in abutment with the pin;

obstacle means located between the lever and the skirt adapted to block movement of the lever toward the skirt;

compression spring biasing means for biasing the lever toward said obstacle means into said lock position and located, in use, between the lever and the well so as to bear on the lever at one end and on the well at the other end; and access means comprising a number of apertures in the skirt, each positioned adjacent a locking assembly, adapted to allow movement of the lever against said biasing means and bringing the lever into said release position so that the associated pin may be slid out of the extended configuration for removal of the tree from the stand.

* * * * *